US011158254B1

(12) United States Patent
Cai

(10) Patent No.: US 11,158,254 B1
(45) Date of Patent: Oct. 26, 2021

(54) SUB-PIXEL CIRCUIT, PIXEL CIRCUIT, AND DISPLAY DEVICE

(71) Applicant: Shenzhen China Star Optoelectronics Semiconductor Display Technology Co., Ltd., Shenzhen (CN)

(72) Inventor: Zhenfei Cai, Shenzhen (CN)

(73) Assignee: SHENZHEN CHINA STAR OPTOELECTRONICS SEMICONDUCTOR DISPLAY TECHNOLOGY CO. LTD., Shenzhen (CN)

( * ) Notice: Subject to any disclaimer, the term of this patent is extended or adjusted under 35 U.S.C. 154(b) by 204 days.

(21) Appl. No.: 16/625,679

(22) PCT Filed: Dec. 13, 2019

(86) PCT No.: PCT/CN2019/125056
§ 371 (c)(1),
(2) Date: Dec. 21, 2019

(87) PCT Pub. No.: WO2021/103172
PCT Pub. Date: Jun. 3, 2021

(30) Foreign Application Priority Data

Nov. 26, 2019 (CN) ..... 201911177906.X

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01);
(Continued)

(58) Field of Classification Search
CPC .. G09G 3/3233; G09G 3/3266; G09G 3/3275; G09G 2330/02; G09G 2300/0809; G09G 2320/0233; G09G 2300/0443
See application file for complete search history.

(56) References Cited

U.S. PATENT DOCUMENTS

2011/0242072 A1* 10/2011 Ota ..... G09G 3/3233 345/204
2014/0333512 A1 11/2014 In et al.
(Continued)

FOREIGN PATENT DOCUMENTS

CN 1912976 A 2/2007
CN 102214439 A 10/2011
(Continued)

*Primary Examiner* — Premal R Patel
(74) *Attorney, Agent, or Firm* — Luedeka Neely Group, P.C.

(57) ABSTRACT

A sub-pixel circuit, a pixel circuit, and a display device are provided. The sub-pixel circuit includes a main pixel unit and a sub-pixel unit respectively connected to scan lines and data lines, the main pixel unit is further connected to a power supply line, and the main pixel unit includes a first organic light emitting diode (OLED) and a capacitor, the sub-pixel unit includes a second OLED and a second capacitor, the first capacitor is charged through the data lines and the power supply line, and the second capacitor is charged through the data lines, such that brightness of the first OLED is greater than brightness of the second OLED. This enables multiple brightness display of a single OLED pixel, improving display contrast, and pixel charging rate.

17 Claims, 3 Drawing Sheets

(52) U.S. Cl.
CPC ..... *G09G 2300/0443* (2013.01); *G09G 2300/0809* (2013.01); *G09G 2320/0233* (2013.01); *G09G 2330/02* (2013.01)

(56) References Cited

U.S. PATENT DOCUMENTS

| | | | | |
|---|---|---|---|---|
| 2015/0015468 | A1* | 1/2015 | Ko | G09G 3/3233 345/82 |
| 2015/0332628 | A1 | 11/2015 | Ren et al. | |
| 2017/0076646 | A1* | 3/2017 | Gu | G09G 3/3266 |
| 2017/0263184 | A1 | 9/2017 | Chen et al. | |
| 2017/0358257 | A1 | 12/2017 | Lin et al. | |
| 2018/0019432 | A1 | 1/2018 | Kurasawa et al. | |
| 2018/0182289 | A1* | 6/2018 | Jung | G09G 3/3258 |
| 2018/0239207 | A1 | 8/2018 | Ying | |
| 2020/0035165 | A1* | 1/2020 | Park | G09G 3/3233 |
| 2020/0243012 | A1 | 7/2020 | Jin et al. | |

FOREIGN PATENT DOCUMENTS

| | | | |
|---|---|---|---|
| CN | 103489401 | A | 1/2014 |
| CN | 104200776 | A | 12/2014 |
| CN | 105185321 | A | 12/2015 |
| CN | 205080892 | U | 3/2016 |
| CN | 106710556 | A | 5/2017 |
| CN | 107492346 | A | 12/2017 |
| CN | 107611156 | A | 1/2018 |
| CN | 109493806 | A | 3/2019 |
| CN | 109507817 | A | 3/2019 |
| CN | 109616064 | A | 4/2019 |
| CN | 110428774 | A | 11/2019 |
| CN | 110429124 | A | 11/2019 |

* cited by examiner

SUB-PIXEL CIRCUIT, PIXEL CIRCUIT, AND DISPLAY DEVICE

FIELD OF INVENTION

The present disclosure relates to the field of organic light emitting diode (OLED) technologies, and more particularly to a sub-pixel circuit, a pixel circuit, and a display device.

BACKGROUND OF INVENTION

Current organic light emitting diode (OLED) pixel circuits usually can only display a group of pixel circuits corresponding to one kind of brightness at the same display time.

Generally, in large-size OLED pixel driving circuits, each sub-pixel includes three thin film transistors (TFTs), a storage capacitor, data lines arranged vertically, and scan lines arranged horizontally. The scan lines scan horizontally and progressively, and the data lines sequentially transmit gray-scale voltage to complete a data writing and light emission of each pixel.

SUMMARY OF INVENTION

The present invention provides a sub-pixel circuit, a pixel circuit, and a display device capable of solving issues that a group of pixel circuits can only display one kind of brightness correspondingly in the prior art.

In one aspect, an embodiment of the present invention provides a sub-pixel circuit comprising a main pixel unit and a sub-pixel unit respectively connected to scan lines and data lines. The main pixel unit is further connected to a power supply line, and the main pixel unit comprises a first organic light emitting diode (OLED) and a capacitor, the sub-pixel unit comprises a second OLED and a second capacitor, the first capacitor is charged through the data lines and the power supply line, and the second capacitor is charged through the data lines, such that brightness of the first OLED is greater than brightness of the second OLED.

In the sub-pixel circuit according to an embodiment of the present invention, the main pixel unit is connected to an nth scan line, and the sub-pixel unit is connected to an n+1th scan line.

In the sub-pixel circuit according to an embodiment of the present invention, the main pixel unit further comprises a first transistor, a second transistor, and a third transistor. A first end of the first transistor is connected to the data lines, a second end of the first transistor is connected to the scan lines, a third end of the first transistor is connected to a first end of the second transistor and an end of the first capacitor, a second end of the second transistor is connected to another end of the first capacitor, the first OLED, and a first end of the third transistor, a second end of the third transistor is connected to the scan lines, and a third end of the third transistor is connected to the power supply line.

In the sub-pixel circuit according to an embodiment of the present invention, a third end of the second transistor is connected to a first voltage terminal.

In the sub-pixel circuit according to an embodiment of the present invention, the sub-pixel unit comprises a fourth transistor and a fifth transistor. A first end of the fourth transistor is connected to the data lines, a second end of the fourth transistor is connected to the scan lines, a third end of the fourth transistor is connected to a first end of the fifth transistor and an end of the second capacitor, and a second end of the fifth transistor is connected to another end of the second capacitor and the second OLED.

In the sub-pixel circuit according to an embodiment of the present invention, a third end of the fifth transistor is connected to a second voltage terminal.

In the sub-pixel circuit according to an embodiment of the present invention, the power supply line provides a direct current (DC) constant voltage signal to the main pixel unit.

In the sub-pixel circuit according to an embodiment of the present invention, the first OLED and the second OLED are both active matrix organic light emitting diodes.

In one aspect, an embodiment of the present invention provides a pixel circuit comprising three sub-pixel circuits. A first OLED included in each of the three sub-pixel circuits is configured to emit red light, green light, and blue light, respectively. A second OLED included in each of the three sub-pixel circuits is configured to emit red light, green light, and blue light, respectively.

In one aspect, an embodiment of the present invention provides a display device comprising a pixel circuit.

Beneficial effects of the present application reach multiple brightness display of a single OLED pixel, improving display contrast, and pixel charging rate.

DESCRIPTION OF DRAWINGS

The present invention will be further described below with reference to the accompanying drawings and embodiments. In the drawings.

DETAILED DESCRIPTION OF PREFERRED EMBODIMENTS

In order to have a clearer understanding of technical features, objects, and effects of the present invention, specific embodiments of the present invention will now be described in detail with reference to the drawings.

Figure 1:
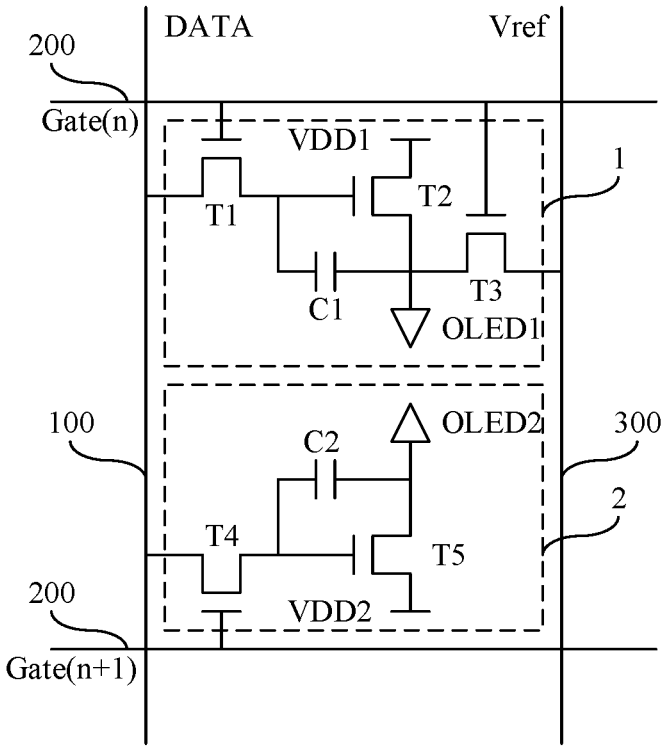
FIG. 1 is a structural diagram of a sub-pixel circuit according to an embodiment of the present invention.

Referring to FIG. 1, FIG. 1 is a structural diagram of a sub-pixel circuit according to an embodiment of the present invention. The sub-pixel circuit comprises a main pixel unit 1 and a sub-pixel unit 2 respectively connected to scan lines 200 and data lines 100. The main pixel unit 1 is further connected to a power supply line 300, and the main pixel unit 1 comprises a first organic light emitting diode (OLED) (OLED 1) and a capacitor C1, the sub-pixel unit 2 comprises a second OLED (OLED 2) and a second capacitor C2, the first capacitor C1 is charged through the data lines 100 and the power supply line 300, and the second capacitor C2 is charged through the data lines 100, such that brightness of the first OLED (OLED 1) is greater than brightness of the second OLED (OLED 2). That is, among existing vertical data lines 100 and horizontal scan lines 200, the main pixel unit 1 and the sub-pixel unit 2 are connected to the scan lines 200 and the data lines 100 at the same time.

The main pixel unit 1 adopts a 3T1C structure, that is, a structure of three transistors and a capacitor. The transistor is preferably a thin film transistor (TFT). The main pixel unit 1 further comprises a first transistor T1, a second transistor T2, a third transistor T3 and a first capacitor C1. A first end of the first transistor T1 is connected to the data lines 100, a second end of the first transistor T1 is connected to the scan lines 200, a third end of the first transistor T1 is connected to a first end of the second transistor T2 and an end of the first capacitor C1, a second end of the second transistor T2 is connected to another end of the first capacitor C1, the first OLED (OLED 1), and a first end of the third transistor T3, a second end of the third transistor T3 is connected to the scan lines 200, and a third end of the third transistor T3 is connected to the power supply line 300. A third end of the second transistor T2 is connected to a first voltage terminal VDD1.

The sub-pixel unit 2 adopts a 2T1C structure. The sub-pixel unit 2 comprises a fourth transistor T4 and a fifth transistor T5. A first end of the fourth transistor T4 is connected to the data lines 100, a second end of the fourth transistor T4 is connected to the scan lines 200, a third end of the fourth transistor T4 is connected to a first end of the fifth transistor T5 and an end of the second capacitor C2, and a second end of the fifth transistor T5 is connected to another end of the second capacitor C2 and the second OLED (OLED 2). A third end of the fifth transistor T5 is connected to a second voltage terminal VDD2.

Figure 2:
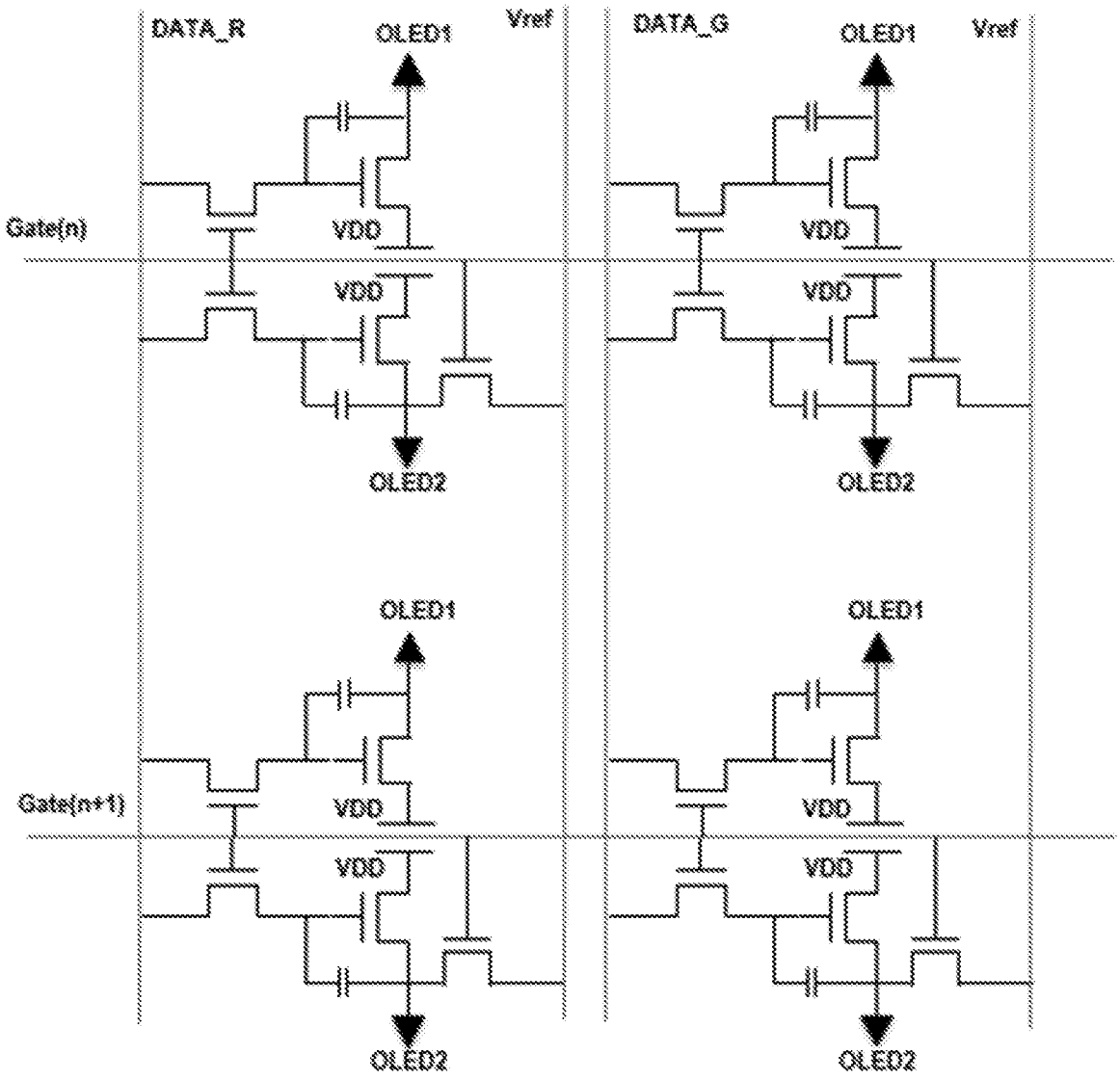
FIG. 2 is a schematic structural diagram of a sub-pixel circuit according to an embodiment of the present invention.
Figure 3:
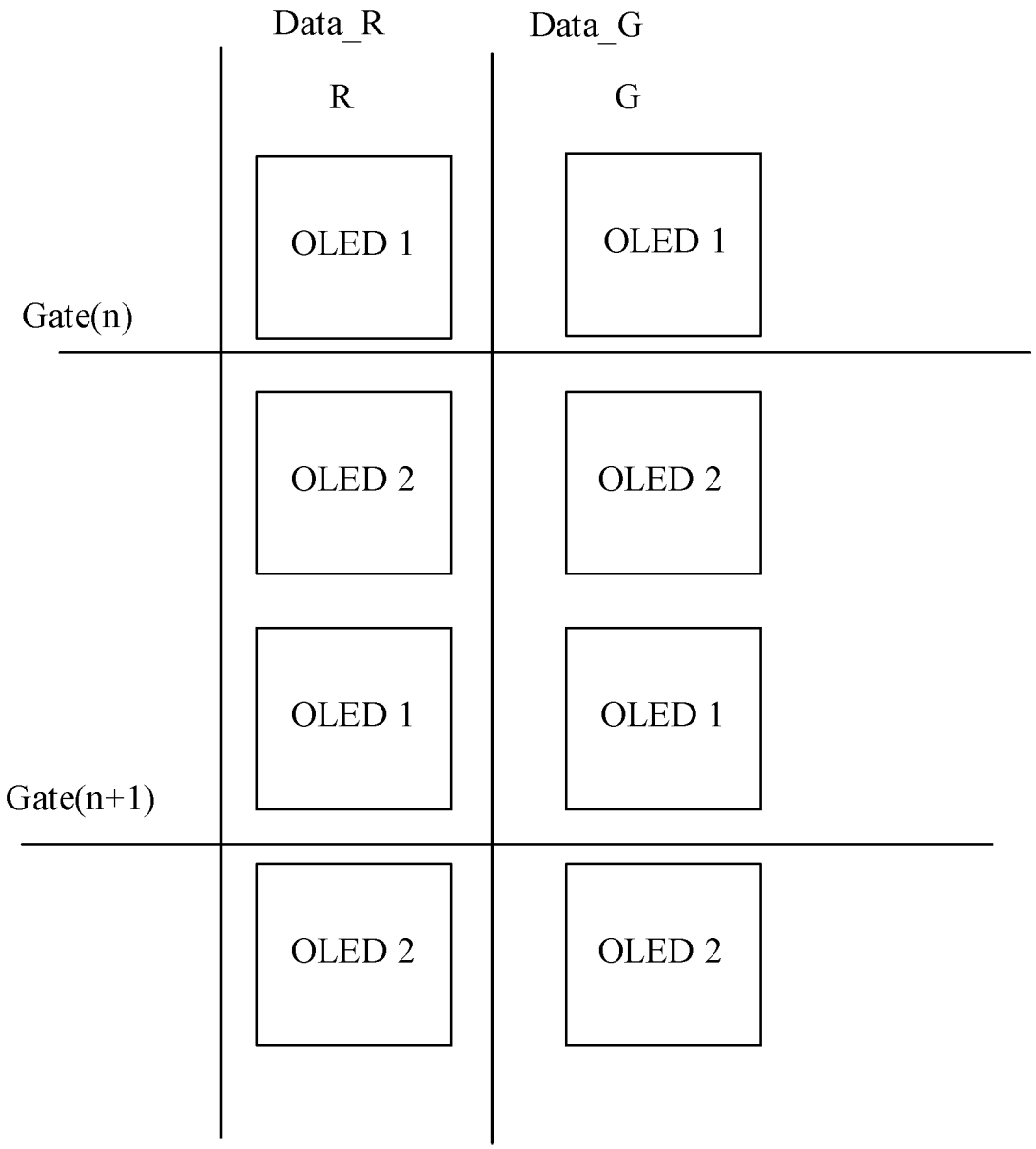
FIG. 3 is a schematic diagram of light emission of a sub-pixel circuit according to an embodiment of the present invention.

Referring to FIG. 2, FIG. 2 is a schematic structural diagram of a sub-pixel circuit according to an embodiment of the present invention. The schematic structural diagram shows two sub-pixel (DATA_R, DATA_G) architectures at Gate (n) and Gate (n+1), respectively. Gate (n) is a nth scan line 200, Gate (n+1) is a n+1th scan line 200, DATA_R is red data lines 100, and DATA_G is green data lines 100. The main pixel unit charges the storage capacitor (C1) through a Vref line (that is, the power supply line 300) and data lines (that is, the data lines 100) to implement grayscale voltage writing. The sub-pixel unit charges the storage capacitor (C2) through data lines (that is, the data lines 100) to implement grayscale writing. Compared with the main pixel unit, charging rate in this method is relatively low, because one end of the second capacitor C2 cannot be reset, and light emitting brightness of the pixel is relatively low. Referring specifically to FIG. 3, FIG. 3 is a schematic diagram of light emission of a sub-pixel circuit according to an embodiment of the present invention. The brightness of the first OLED (OLED 1) is greater than the brightness of the second OLED (OLED 2).

Preferably, the power supply line 300 provides a direct current (DC) constant voltage signal to the main pixel unit. The first OLED (OLED 1) and the second OLED (OLED 2) are both active matrix organic light emitting diodes.

An embodiment of the present invention further provides a pixel circuit comprising three sub-pixel circuits. A first OLED (OLED 1) included in each of the three sub-pixel circuits is configured to emit red light, green light, and blue light, respectively. A second OLED (OLED 2) included in each of the three sub-pixel circuits is configured to emit red light, green light, and blue light, respectively. This is because an RGB color mode is a color standard in the industry. By changing three color channels of red (R), green (G), and blue (B), and superimposing them on each other, a variety of colors can be obtained. RGB is the color representing the three channels of red, green and blue. This standard includes almost all colors that human vision can perceive and is one of the most widely used color systems.

In addition, an embodiment of the present invention provides a display device comprising a pixel circuit. OLED pixels in the display device adopt a single-drive multi-brightness display design, in which a row of scan lines 200 is simultaneously implemented to display two pixels with different light emission brightness.

The embodiments of the present invention have been described above with reference to the accompanying drawings. However, the present invention is not limited to the specific embodiments described above. The specific embodiments described above are merely illustrative and not restrictive. Those of ordinary skill in the art can make many forms under the inspiration of the present invention without departing from the scope of the present invention and the scope of the claims. These are all within the protection of the present invention.

What is claimed is:

1. A sub-pixel circuit, comprising:

a main pixel unit and a sub-pixel unit respectively connected to scan lines and data lines;

wherein the main pixel unit is further connected to a power supply line, and the main pixel unit comprises a first organic light emitting diode (OLED) and a capacitor, the sub-pixel unit comprises a second OLED and a second capacitor, the first capacitor is charged through the data lines and the power supply line, and the second capacitor is charged through the data lines, such that brightness of the first OLED is greater than brightness of the second OLED.

2. The sub-pixel circuit according to claim 1, wherein the main pixel unit is connected to an nth scan line, and the sub-pixel unit is connected to an n+1th scan line.

3. The sub-pixel circuit according to claim 1, wherein the main pixel unit further comprises a first transistor, a second transistor, and a third transistor;

wherein a first end of the first transistor is connected to the data lines, a second end of the first transistor is connected to the scan lines, a third end of the first transistor is connected to a first end of the second transistor and an end of the first capacitor, a second end of the second transistor is connected to another end of the first capacitor, the first OLED, and a first end of the third transistor, a second end of the third transistor is connected to the scan lines, and a third end of the third transistor is connected to the power supply line.

4. The sub-pixel circuit according to claim 3, wherein a third end of the second transistor is connected to a first voltage terminal.

5. The sub-pixel circuit according to claim 1, wherein the sub-pixel unit comprises a fourth transistor and a fifth transistor;

wherein a first end of the fourth transistor is connected to the data lines, a second end of the fourth transistor is connected to the scan lines, a third end of the fourth transistor is connected to a first end of the fifth transistor and an end of the second capacitor, and a second end of the fifth transistor is connected to another end of the second capacitor and the second OLED.

6. The sub-pixel circuit according to claim 5, wherein a third end of the fifth transistor is connected to a second voltage terminal.

7. The sub-pixel circuit according to claim 1, wherein the power supply line provides a direct current (DC) constant voltage signal to the main pixel unit.

8. The sub-pixel circuit according to claim 1, wherein the first OLED and the second OLED are both active matrix organic light emitting diodes.

9. A pixel circuit, comprising:

three sub-pixel circuits;

wherein each of the sub-pixel circuits comprises a main pixel unit and a sub-pixel unit respectively connected to scan lines and data lines, the main pixel unit is further connected to a power supply line, and the main pixel unit comprises a first organic light emitting diode (OLED) and a capacitor, the sub-pixel unit comprises a second OLED and a second capacitor, the first capacitor is charged through the data lines and the power supply line, and the second capacitor is charged through the data lines, such that brightness of the first OLED is greater than brightness of the second OLED; and wherein the first OLED is configured to emit red light, green light, and blue light, respectively, and the second OLED is configured to emit red light, green light, and blue light, respectively.

10. The pixel circuit according to claim 9, wherein the main pixel unit is connected to an nth scan line, and the sub-pixel unit is connected to an n+1th scan line.

11. The pixel circuit according to claim 9, wherein the main pixel unit further comprises a first transistor, a second transistor, and a third transistor;

wherein a first end of the first transistor is connected to the data lines, a second end of the first transistor is connected to the scan lines, a third end of the first transistor is connected to a first end of the second transistor and an end of the first capacitor, a second end of the second transistor is connected to another end of the first capacitor, the first OLED, and a first end of the third transistor, a second end of the third transistor is connected to the scan lines, and a third end of the third transistor is connected to the power supply line.

12. The pixel circuit according to claim 11, wherein a third end of the second transistor is connected to a first voltage terminal.

13. The pixel circuit according to claim 9, wherein the sub-pixel unit comprises a fourth transistor and a fifth transistor;

wherein a first end of the fourth transistor is connected to the data lines, a second end of the fourth transistor is connected to the scan lines, a third end of the fourth transistor is connected to a first end of the fifth transistor and an end of the second capacitor, and a second end of the fifth transistor is connected to another end of the second capacitor and the second OLED.

14. The pixel circuit according to claim 13, wherein a third end of the fifth transistor is connected to a second voltage terminal.

15. The pixel circuit according to claim 9, wherein the power supply line provides a direct current (DC) constant voltage signal to the main pixel unit.

16. The pixel circuit according to claim 9, wherein the first OLED and the second OLED are both active matrix organic light emitting diodes.

17. A display device, comprising:

a pixel circuit;

wherein the pixel circuit comprises three sub-pixel circuits;

wherein each of the sub-pixel circuits comprises a main pixel unit and a sub-pixel unit respectively connected to scan lines and data lines, the main pixel unit is further connected to a power supply line, and the main pixel unit comprises a first organic light emitting diode (OLED) and a capacitor, the sub-pixel unit comprises a second OLED and a second capacitor, the first capacitor is charged through the data lines and the power supply line, and the second capacitor is charged through the data lines, such that brightness of the first OLED is greater than brightness of the second OLED; and wherein the first OLED is configured to emit red light, green light, and blue light, respectively, and the second OLED is configured to emit red light, green light, and blue light, respectively.

* * * * *